United States Patent [19]

Leluschko et al.

[11] Patent Number: 4,848,986

[45] Date of Patent: Jul. 18, 1989

[54] SELFSUPPORTING-CORONA-DISCHARGE ELECTRODE

[75] Inventors: Georg Leluschko, Rödermark; Willi Michler, Frankfurt am Main; Hermann Koy, Alzenau-Albstadt, all of Fed. Rep. of Germany

[73] Assignee: Metallgesellschaft Aktiengesellschaft, Frankfurt am Main, Fed. Rep. of Germany

[21] Appl. No.: 181,306

[22] Filed: Apr. 13, 1988

[30] Foreign Application Priority Data

Apr. 15, 1987 [DE] Fed. Rep. of Germany ..... 3712726

[51] Int. Cl.[4] ..... B03C 3/40

[52] U.S. Cl. ..... 55/152; 361/230

[58] Field of Search ..... 55/152, 129, 130, 156; 361/230

[56] References Cited

U.S. PATENT DOCUMENTS

| | | | |
|---|---|---|---|
| 3,158,454 | 11/1964 | Gustafsson | 55/152 |
| 3,435,594 | 4/1969 | Steuernagel | 55/130 X |
| 4,321,068 | 3/1982 | Cottrell et al. | 55/151 X |
| 4,375,364 | 3/1983 | Van Hoesen et al. | 55/152 |
| 4,666,475 | 5/1987 | Gustavsson | 55/152 X |

FOREIGN PATENT DOCUMENTS

| | | | |
|---|---|---|---|
| 401997 | 7/1967 | Australia | 55/152 |
| 2603514 | 8/1977 | Fed. Rep. of Germany . | |
| 3408839 | 9/1985 | Fed. Rep. of Germany . | |
| 855621 | 12/1960 | United Kingdom | 55/152 |
| 1575404 | 9/1980 | United Kingdom | 55/152 |

OTHER PUBLICATIONS

"Stand der Rauchgasentstaubung" (W. Braun), Technische Mitteilungen (1978) No. 3, pp. 123–131.

*Primary Examiner*—Bernard Nozick
*Attorney, Agent, or Firm*—Herbert Dubno

[57] ABSTRACT

Selfsupporting mastlike corona discharge electrodes are proposed for use in a dustcollecting electrostatic precipitator having gas passage-forming platelike collecting electrodes. From a metal strip which has the same width everywhere the corona discharge electrode can be manufactured continuously in any desired length and virtually without a waste of material. By cutting and bending operations the metal strip is formed to constitute a selfsupporting corona discharge electrode which has an adequate flexural stiffness and is provided with the required corona discharge tips.

13 Claims, 3 Drawing Sheets

Fig.1
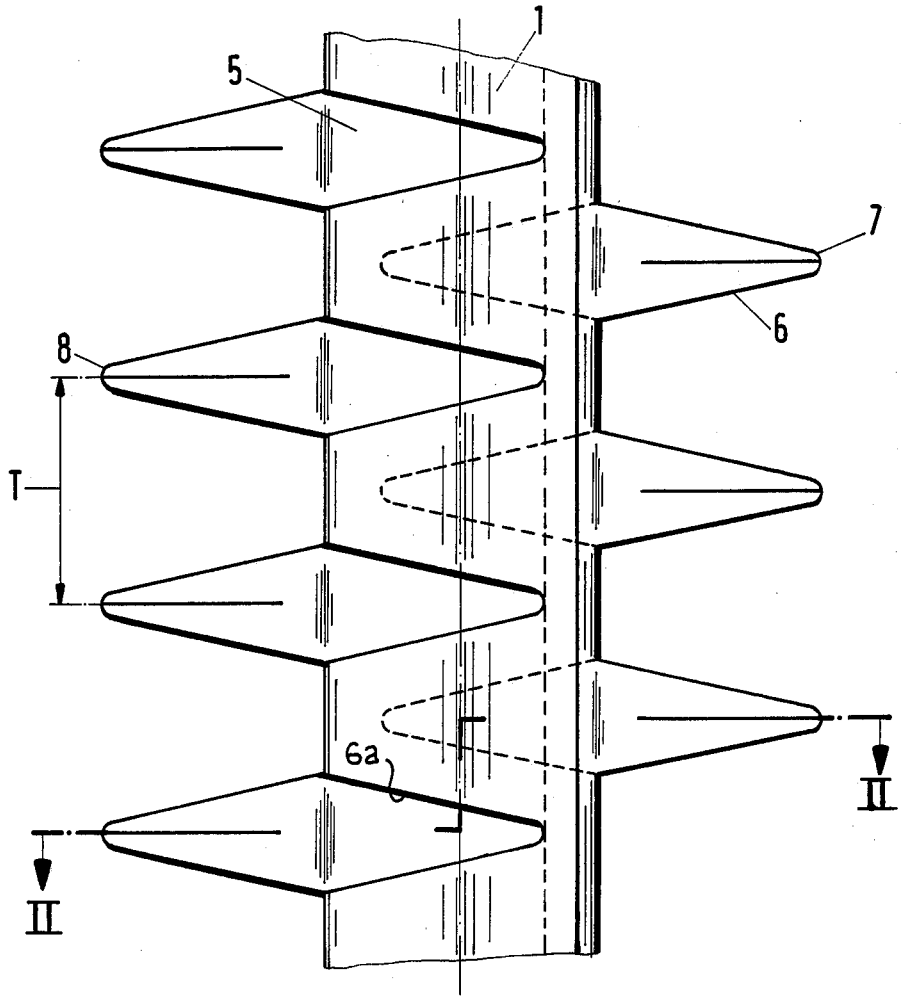
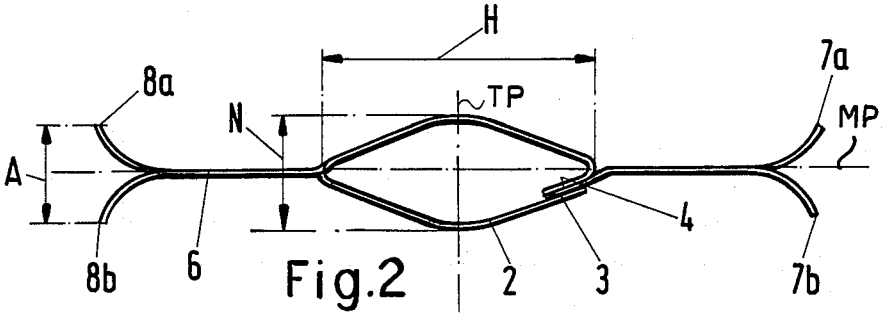
Fig.2

Fig.3
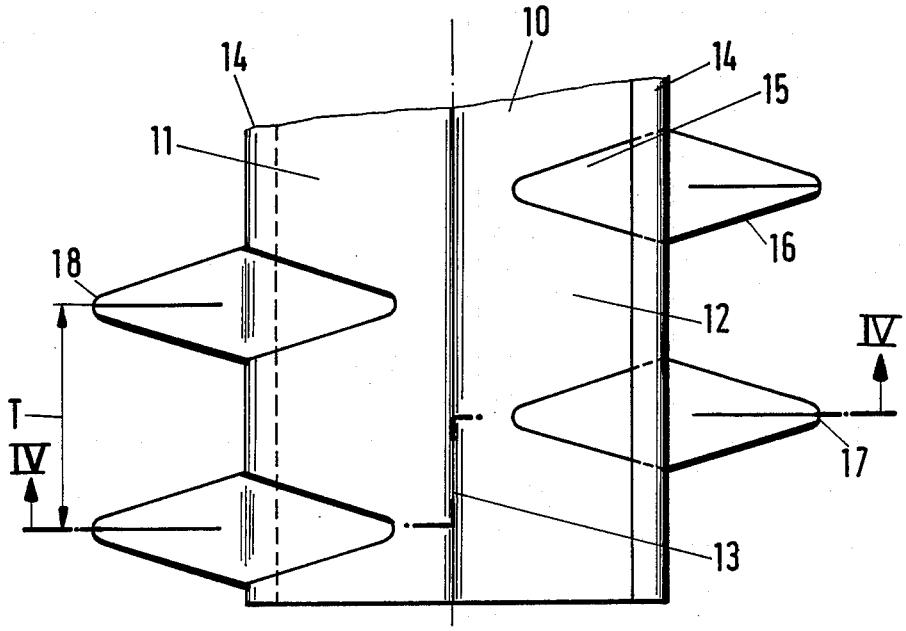
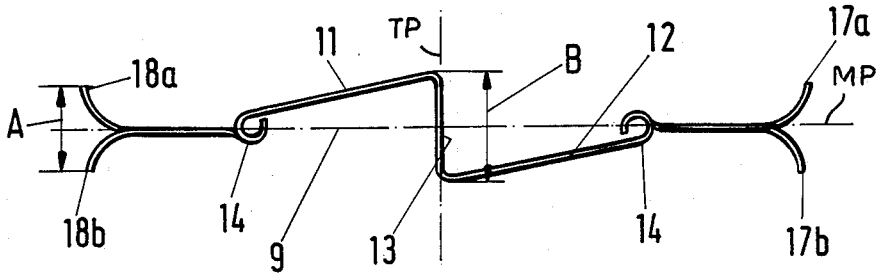
Fig.4

SELFSUPPORTING-CORONA-DISCHARGE ELECTRODE

FIELD OF THE INVENTION

Our present invention relates to a selfsupporting mastlike corona-discharge electrode for use in dust-collecting electrostatic precipitators having gas-passage-forming platelike collecting electrodes.

BACKGROUND OF THE INVENTION

Corona-discharge electrodes and collecting electrodes are the most important components of a dust-collecting electrostatic precipitator and are shaped and arranged so as to match each other.

In most cases, the collecting electrodes are grounded and the corona-discharge electrodes are connected to a high-voltage source.

The dust particles to be collected are ionized by electrons discharged by the corona-discharge electrodes and are deflected out of the gas stream in the electrostatic field that is established between the corona-discharge electrodes and the collecting electrodes. The dust particles are finally collected on the collecting electrodes.

Particularly the collecting electrodes but also the corona discharge electrodes are shaken in certain intervals of time by rapping blows so that the collected dust is detached and falls down into dust-collecting bins. The effectiveness of a dust-collecting electrostatic precipitator depends on the adoption of the corona discharge electrodes and collecting electrodes for their various functions.

Many corona-discharge electrodes consist of wires or strips which are tensioned in a frame and provided with pointed tips. Associated collecting electrodes are assembled from profiled metal strips to constitute boundary walls of gas passages. Corona-discharge electrodes are centrally disposed in the gas passages and their tips extend in such directions that an optimum field for the collection of dust is established (see Published German Application No. 34 08 839).

The corona-discharge electrodes which are tensioned in a frame must be manufactured with great care to ensure that all strips or wires will be uniformly tensioned. If the electrodes are under an inadequate tension, the influences of the flowing gases and of the electric field forces will result in uncontrolled vibration and possibly in a decrease of the distance to the collecting electrodes so that undesired flashovers occur.

Excessively tensioned strips or wires may be torn off under the action of the rapping blows so that the dust-extracting capacity will be reduced and downtimes become necessary, which are expensive particularly in power plants. For this reason, special tools for uniformly tensioning the electrodes have been proposed (Published German Application No. 26 03 514).

Corona-discharge electrodes consisting of wires tensioned in frames can be made in a shop only up to certain sizes. Limits are imposed by the maximum dimensions which are permissible for transportation. But particularly in the design of power plants there is a trend toward larger units so that larger dust-collecting electrostatic precipitators are also required. For instance, a power unit of 740 megawatts requires two dust-collecting electrostatic precipitators each of which has a length of about 33 meters, a width of 37 meters and a height of 23 meters. Each precipitator has a projected collecting electrode surface area of about 70,000 $m^2$ and contains corona electrodes having a total length of about 220 km (periodical "Technische Mitteilungen" (1978), No. 3, pages 123 to 131.

It will readily be understood that one-piece mounting frames cannot be used in conjunction with collecting electrodes having a height up to 15 meters. But even frames which have a height of 7.5 meters and have a width of about 6 meters in the direction of gas flow can no longer be transported. If they are made on the building site, the compliance with the manufacturing tolerances, which must be very small, involves a considerable expenditure. Besides, such large frames can be handled only with difficulty.

Some operators of dust-collecting electrostatic precipitators hesitate to use corona-discharge electrodes consisting of wires tensioned in frames. While such electrodes can be installed and aligned quickly, they do not permit of a repair of individual wires. For a repair, the entire frame must be removed and when a new wire has been fixed all wires must be retensioned or must at least be checked whether they are uniformly tensioned.

Other corona-discharge electrodes have been disclosed which consist of relatively rigid components, such as profiled plates or masts or the like (see U.S. Pat. Nos. 3,435,594 & 4,321,068). In such cases the design of the corona discharge electrodes will determine the required design of the collecting electrodes so that the collecting electrodes are designed in adaptation to the corona discharge electrodes rather than vice versa as is the case with wires tensioned in frames. This need not be a disadvantage. But because collecting electrodes having an optimum profiled shape have been developed for use with wires tensioned in frames, it is desired to use such collecting electrodes also where corona discharge electrodes consisting of wires tensioned in frames cannot be adopted.

OBJECT OF THE INVENTION

It is an object of our present invention to provide selfsupporting corona-discharge electrodes which do not compromise tensioned wires or strips tensioned in frames and can be used without a need for an alteration of a given system of collecting electrodes.

SUMMARY OF THE INVENTION

This object and others which will become more readily apparent hereinafter are attained, in accordance with the invention, in a selfsupporting mastlike corona-discharge electrode for use in a dust-collecting electrostatic precipitator having gas-passage-forming platelike collecting electrodes, the selfsupporting mastlike corona-discharge electrode comprising:

an elongated metal strip of constant width over its entire length, of nonplanar cross section and bent to have portions lying out of a median plane so that the strip is intrinsically resistant to bending transverse to the median plane, the strip being formed with:

longitudinally equispaced generally triangular lugs cut out of the strip on opposite sides of a transverse plane perpendicular to the median plane and bent outwardly away from the transverse plane to lie generally in the median plane and form generally triangular flags projecting outwardly from the strip adjacent generally triangular cutouts from which the lugs are bent, the generally triangular flags on opposite sides of the transverse plane being longitudinally offset from one another by about half the longitudinal spacing between the flags on each side of the transverse plane.

Preferably the central portion, spine or backbone of the selfsupporting electrode has an approximately elliptical cross section and is tubular or is of a slender Z-shaped cross section having tubular edge beads at the free edges of the electrode spine in the median plane. In the first case, the median plane is the plane of the major axis of the elliptical cross section while the transverse plane is the plane of the minor axis of the cross section. In the second case, the web connecting the arms of the Z can lie in the transverse plane.

In the first embodiment, therefore, the corona-discharge electrode:

(a) consists of a metal strip, which has the same width everywhere and (b) which has been formed to have an approximately elliptical tubular cross-section and has longitudinal edges, which overlap and are joined to each other, wherein (c) approximately triangular lugs have been bent from the tubular cross-section in such a manner that (d) they constitute flags, which extend outwardly on both sides of the elliptical tubular cross-section in alignment with the major axis of said cross-section, and (e) the outermost portions of said flags constitute corona discharge tips, which are disposed on different levels on opposite sides.

Advantageously the outwardly directed flags have central incisions and outermost portions or tips separated by each incision mutually bent by about 70° in mutually opposite directions (out of the median plane) to form the corona tips. The length ratio of the major axis of the ellipse to the minor axis can range from about 2.4:1 to 2.7:1.

Preferably the length to which each flag projects from the spine of the electrode is 85 to 90% of the length of the major axis while the greatest distance between the mutually oppositely bent tips is 30 to 90% of the length of the major axis.

The tubular structure can be closed between the overlapping edges of the sheet metal strip from which the spine is formed by flanging or welding. The center spacing of the outwardly extending flags can be 80 to 85% of the length of the major axis.

In the second embodiment the electrode:

(a) consists of a metal strip, which has the same width everywhere and (b) has edge strips which have the same width and have been mutually oppositely flanged from a narrow central strip, wherein the longitudinal edges of the edge strips have been inturned or bent to form beads in the same sense as the associated edge strip so that a slender Z-shaped cross-section has been obtained in which the centers of the edge beads lie on an axis of symmetry that is at right angles to the central strip, (c) approximately triangular lugs have been bent from the edge strips in such a manner that they (d) constitute flags, which extend outwardly in the plane of symmetry from the apices of the edge flanges, and (e) the outermost portions of said flags constitute corona-discharge tips, which are disposed on different levels on opposite sides.

In this embodiment as well, the outwardly directed flags have central incisions and outermost portions or tips separated by each incision mutually bent by about 70° in mutually opposite directions (out of the median plane) to form the corona tips. The edge strips of the Z-section spine can have widths about three times that of the central strip.

The lengths of the flags can be about one-half the widths of the edge strips while the largest distance between the mutually oppositely bent discharge tips can be about equal to the widths of the edge strips. The center spacing of the outwardly extending flags can be about 70% of the width of an edge strip.

Both embodiments can be made from a metal strip virtually without waste. In accordance with the invention that strip is shaped to have the stiffness which is required for such corona discharge electrodes and the corona-discharge tips are integral with the parts carrying them so that no joints are required which in composite corona discharge electrodes have been found by experience to give rise to high electrical contact resistances and to a higher danger of corrosion.

BRIEF DESCRIPTION OF THE DRAWING

The above and other objects, features and advantages of our invention will become more readily apparent from the following description, reference being made to the accompanying highly diagrammatic drawing in which:

FIG. 1 is a fragmentary elevation of a first embodiment;

FIG. 2 is a section along line II—II of FIG. 1;

FIG. 3 is a fragmentary elevation of the second embodiment;

FIG. 4 is a section along line IV—IV of FIG. 3;

SPECIFIC DESCRIPTION

Figure 5:
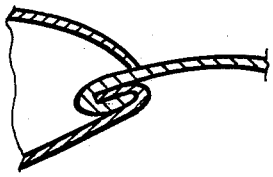
FIG. 5 is a sectional view of a flanged seam.
Figure 6:
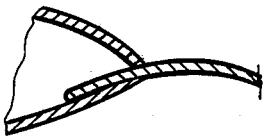
FIG. 6 is a sectional view of a welded seam.

FIG. 1 is a side elevation showing a portion of a mastlike corona discharge electrode. FIG. 2 shows the cross-sectional shape of that corona discharge electrode.

The corona discharge electrode has been made from a metal strip 1 of constant width in that the metal strip 1 has been shaped to have an approximately elliptical tubular cross-section 2, i.e., an oblong tubular cross-section, which has a major axis of symmetry and a minor axis of symmetry which is shorter than the major axis of symmetry.

The longitudinal edges 3, 4 of the metal strip 1 overlap and are joined by welding or by flanging.

Triangular lugs 5 are bent from the tubular cross-section 2 in such a manner that they form flags 6, which extend outwardly on both sides of the elliptical tubular cross-section 2 in alignment with its major axis H leaving cutouts **6*a*** in the spine.

The outermost portions of said flags constitute corona discharge tips 7, 8, which are disposed on different levels on opposite sides.

The outwardly extending flags 6 have central incisions and their outermost portions have been bent in mutually opposite senses by about 70° to form two corona discharge tips **7*a*/7*b*, 8*a*/8*b*** each.

The length ratio of the major axis H to the minor axis N of the elliptical tubular cross-section 2 is suitably in the range from 2.4 to 2.7:1. The length of the extended flag 6 is 85 to 90% of the length of the major axis H of the elliptical tubular cross-section 2.

In addition, the largest distance A between the oppositely bent corona discharge points **8*a* and 8*b*** is 30 to 90% of the length of the major axis H of the tubular cross-section 2. The longitudinal edges 3, 4 are joined, as noted by flanging or welding (e.g. spot or seam welding). The center spacing T of the outwardly directed flags 6 suitably amounts to 80 to 85% of the length of the major axis H of the tubular cross-section 2. The median plane MP and the transverse plane TP have also been shown in FIG. 2.

FIG. 3 is a side elevation showing a portion the second embodiment of a mastlike corona discharge electrode FIG. 4 shows also the cross-sectional shape of the electrode.

In that case too the corona discharge electrode has also been made from a metal strip 10, which has the same width everywhere. Edge strips 11, 12 have been flanged in mutually opposite senses from a narrow central strip 13.

The longitudinal edges of the edge strips 11, 12 have been inturned or bent to form beads in the same sense as the respective edge strip so that a slender Z-shaped cross-section is obtained, in which the center of the edge beads 14 lie on an axis of symmetry 9 coinciding with the median plane MP that is at right angles to the center strip 13 which lies in the transverse plane TP.

Approximately triangular lugs 15 have been bent from the edge strips 11, 12 in such a manner that said lugs constitute flags 16, which extend outwardly from the apices of the edge beads 14 in the plane of symmetry 9.

The outermost portions of the flags 16 constitute corona discharge tips 17, 18, which are disposed on different levels on opposite sides. The outwardly directed flags 16 have central incisions and their outermost portions have been bent through about 70° in mutually opposite senses to form two corona discharge tips 17*a*/17*b* or 18*a*/18*b* each.

The width of the extended edge strips 11, 12 is about three times the width of the central strip 13. Besides, the length of the extended flags 16 is about one-half the width of the extended edge strips 11, 12.

The largest distance A between the oppositely bent corona discharge tips 18*a*/18*b* is approximately as large as the width B of the central strip 14. The center spacing T of the outwardly directed flags 16 is about 70% of the width of the extended edge strips 11, 12.

Both embodiments of the invention constitute self-supporting mastlike corona discharge electrodes, which meet all requirements stated hereinbefore. They can be made in a particularly desirable manner and virtually without any waste of material and are shaped to have the required stiffness. Both embodiments can be made continuously and in any desired length on suitable machines and the consecutive cutting and shaping operations can be economically matched to each other. The embodiment of FIGS. 1 and 2 has the advantage that it is stiffer than the embodiment of FIGS. 3 and 4 but its manufacture is somewhat more difficult. The embodiment of FIGS. 3 and 4 can be very conveniently stacked for transportation.

We claim:

1. A selfsupporting mast corona-discharge electrode for use in a dust-collecting electrostatic precipitator having gas-passage-forming plate collecting electrodes, said selfsupporting mast corona-discharge electrode comprising:

an elongated metal strip of constant width over its entire length, of nonplanar cross section and bent to have portions lying out of a median plane so that said strip is intrinsically resistant to ending transverse to said median plane, said strip being formed with:

generally triangular lugs, said lugs being spaced equidistantly from one another by a predetermined longitudinal spacing, and said lugs being cut out of the strip on opposite sides of a transverse plane perpendicular to said median plane and bent outwardly away from said transverse plane to lie generally in said median plane and form generally triangular flags projecting outwardly from said strip adjacent generally triangular cutouts from which said lugs are bent, said flags being spaced from one another by a predetermined longitudinal spacing, and said triangular flags having outermost projecting portions, said outermost portions of said flags constitute corona discharge tips, which are disposed on different levels on opposite sides of said median plane, the generally triangular flags on opposite sides of said transverse plane being longitudinally offset from one another by about one-half the longitudinal spacing between the flags on each side of said transverse plane; wherein said strip has been formed to have an approximately elliptical tubular cross-section with a major axis (H) with a respective length, and a minor axis (N) with a respective length, and has longitudinal edges, which overlap and are joined to each other; and wherein said approximately triangular lugs have been bent from the approximately elliptical tubular cross-section in such a manner that they constitute said flags, which extend outwardly on both sides of the approximately elliptical tubular cross section in alignment with the major axis (H) of said cross section.

2. The corona discharge electrode defined in claim 1 wherein the outwardly directed flags each have a central incision to form two adjacent lateral portions which are mutually bent through about 70° in mutually opposite senses so as to form two corona discharge tips.

3. The corona discharge electrode defined in claim 1 wherein a ratio of the length of the major axis (H) to the length of the minor axis (N) of the approximately elliptical tubular cross-section lies in the range from 2.4 to 2.7:1.

4. The corona discharge electrode defined in claim 1 wherein the flags have a length which is about 85 to 90% of the length of the major axis (H) of the approximately elliptical tubular cross-section.

5. The corona discharge electrode defined in claim 1 wherein the mutually bent corona discharge tips are separated by a distance (A) which at most is about 30 to 90% of the length of the major axis (H) of the tubular cross-section.

6. The corona discharge electrode defined in claim 1 wherein the longitudinal edges are joined to one another by flanging or welding.

7. The corona discharge electrode defined in claim 1 wherein a center spacing (T) of the outwardly extending flags is about 80 to 85% of the length of the major axis (H) of the tubular cross-section.

8. A selfsupporting mast corona-discharge electrode for use in a dust-collecting electrostatic precipitator having gas-passage-forming plate collecting electrodes, said selfsupporting mast corona-discharge electrode comprising:

an elongated metal strip of constant width over its entire length, of nonplanar cross-section and bent to have portions lying out of a median plane so that said strip is intrinsically resistant to bending transverse to said median plane, said strip being formed with:

generally triangular lugs, said lugs being spaced equidistantly from one another by a predetermined longitudinal spacing, and said lugs being cut out of the strip on opposite sides of a transverse plane perpendicular to said median plane and bent outwardly away from said transverse plane to lie generally in said median plane and form generally triangular flags projecting outwardly from said strip adjacent generally triangular cutouts from which said lugs are bent, said flags being spaced from one another by a predetermined longitudinal spacing, and said triangular flags having outermost projecting portions, said outermost portions of said flags constitute corona discharge tips, which are disposed on different levels on opposite sides of said median plane, the generally triangular flags on opposite sides of said transverse plane being longitudinally offset from one another by about one-half the longitudinal spacing between the flags on each side of said transverse plane; which strip has edge strips which have the same width and have been mutually oppositely flanged from a narrow central strip so that a slender Z-shaped cross-section is obtained, said edge strips having longitudinal edges which are bent in the same sense as the associated edge strip to form edge beads having centers and apices, in which the centers of the edge beads lie on an axis of symmetry that is at right angles to the central strip, said narrow central strip having a predetermined width; wherein said approximately triangular lugs have been bent from the edge strips in such a manner that they constitute said flags which extend outwardly in the median plane which is a plane of symmetry from the apices of the edge beads.

9. The corona discharge electrode defined in claim 8 wherein the outwardly extending flags each have a central incision to form two adjacent lateral portions which are mutually bent through about 70° in mutually opposite senses so as to form two corona discharge tips.

10. The corona discharge electrode defined in claim 8 wherein the edge strips, prior to forming of said edge beads, have a width of about three times the width of the central strip.

11. The corona discharge electrode defined in claim 8 wherein extended flags have a length of about one-half a width of the edge strips prior to forming of said edge beads.

12. The corona discharge electrode defined in claim 8 wherein a larger distance (A) between mutually oppositely bent corona discharge tips is about as large as the width of the central strip.

13. The corona discharge electrode defined in claim 8 wherein a center spacing (T) of the outwardly directed flags is about 70° of a width of the edge strips prior to forming of said edge beads.

* * * * *